US007201461B2

(12) United States Patent
Kim et al.

(10) Patent No.: US 7,201,461 B2
(45) Date of Patent: Apr. 10, 2007

(54) APPARATUS FOR CONTROLLING A TEMPERATURE OF AN INK-JET PRINTHEAD

(75) Inventors: Young-jae Kim, Anyang-si (KR); Keon Kuk, Yongin-si (KR); Yong-soo Oh, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 313 days.

(21) Appl. No.: 10/991,930

(22) Filed: Nov. 19, 2004

(65) Prior Publication Data

US 2005/0110819 A1 May 26, 2005

(30) Foreign Application Priority Data

Nov. 21, 2003 (KR) ..... 10-2003-0083040

(51) Int. Cl.
*B41J 29/38* (2006.01)
*B41J 2/05* (2006.01)

(52) U.S. Cl. ..... 347/17; 347/60
(58) Field of Classification Search ..... 347/17, 347/60
See application file for complete search history.

(56) References Cited

U.S. PATENT DOCUMENTS

| | | | | |
|---|---|---|---|---|
| 4,590,362 | A | 5/1986 | Ishima | |
| 5,815,180 | A | 9/1998 | Barbour et al. | |
| 6,286,924 | B1 | 9/2001 | Ahne et al. | 347/10 |
| 2002/0067384 | A1 | 6/2002 | Anderson et al. | |

FOREIGN PATENT DOCUMENTS

| | | |
|---|---|---|
| EP | 0 658 429 | 6/1995 |

*Primary Examiner*—Julian D. Huffman
(74) *Attorney, Agent, or Firm*—Lee & Morse, P.C.

(57) ABSTRACT

An apparatus for controlling a temperature of an ink-jet printhead includes a heater driving field effect transistor (FET) connected to a heater, the heater driving FET for applying a heater voltage to the heater according to a waveform input to a gate of the heater driving FET, a current sensor for converting current flowing between a drain and a source of the heater driving FET into a voltage and for outputting the voltage, a comparator for comparing the voltage output from the current sensor with a predetermined reference voltage, a warming control signal generator for generating a warming control signal in a form of a pulse string, and a switching unit for receiving an output signal from the comparator and the warming control signal, and for outputting the warming control signal according to a level of the output signal from the comparator to the gate of the heater driving FET.

7 Claims, 5 Drawing Sheets

APPARATUS FOR CONTROLLING A TEMPERATURE OF AN INK-JET PRINTHEAD

BACKGROUND OF THE INVENTION

1. Field of the Invention

The present invention relates to an ink-jet printhead. More particularly, the present invention relates to an apparatus for controlling a temperature of an ink-jet printhead that can rapidly control operating conditions of a heater driving field effect transistor (FET) according to a current flowing through the heater driving FET so that a temperature of a printhead substrate is increased to and maintained at a predetermined temperature.

2. Description of the Related Art

To achieve high printing quality, an ink-jet printer heats a printhead substrate to a predetermined temperature and maintains a size of ink droplets discharged from a nozzle of the printhead at a predetermined size. For improved, more stable printing quality, various apparatuses for controlling the temperature of an ink-jet printhead to improve response to a change in the temperature of the printhead substrate have been developed.

In one conventional method of controlling the temperature of a printhead, supplementary heaters, which are resistance heaters, heat a printhead substrate. A plurality of main heater driving transistors, however, which is connected in parallel to increase current flow, is disposed on a middle of the printhead substrate to supply sufficient current to a main heater. Therefore, in the method of controlling the temperature using separate supplementary heaters, the printhead substrate cannot be heated uniformly because the locations of the supplementary heaters are restricted to sides of the printhead substrate due to limited availability of space on the printhead substrate.

In addition, because a temperature sensor disposed around edges of the printhead substrate is located at a different location from the supplementary heaters, it is difficult to quickly control the supplementary heaters in response to the temperature sensed by the temperature sensor.

As an alternative, an apparatus for controlling the temperature of a printhead that heats a printhead substrate using only a main heater, i.e., without resistance heaters, has been suggested, as illustrated in FIG. 1.

Referring to FIG. 1, when the apparatus is in an ink discharging mode, a controller (not shown) drives a driving transistor 16, which has a larger capacity than a warming transistor 18, and allows sufficient current to flow through a main heater 14, which is a resistance heater, to discharge ink.

When the apparatus is in a substrate heating mode, the warming transistor 18, which operates each ink chamber 13 of a printhead, applies a warming pulse to the main heater 14 in response to a warming control signal received when the temperature of the printhead sensed by a temperature sensor (not shown) is lower than a predetermined temperature to maintain the temperature at the predetermined temperature.

Since the warming transistor 18 increases the temperature of the substrate using the main heater 14, a signal output from the warming transistor 18 to the main heater 14 must be limited to have a low enough voltage or a short enough signal pulse width so as not to discharge ink 10 via a nozzle 12. Therefore, it takes a significant amount of time to increase the temperature of the substrate to the predetermined temperature due to a low heating temperature of the main heater 14.

FIG. 2 is a circuit diagram of a conventional apparatus for controlling the temperature of a printhead that heats a printhead substrate using an on-resistance of a transistor. This method uses an operating resistance of a transistor and does not include a resistance heater as a supplementary heater.

Referring to FIG. 2, when a control signal Q1 applied to a gate of a first pass FET 200 is at a high level, a voltage source connected to a drain of the first pass FET 200 is supplied to a drain of a second pass FET 210, which includes a plurality of transistors, and a drain of an enable FET 220, via a source of the first pass FET 200. The drain voltage of the enable FET 220 is applied to a gate of a main heater driving FET 230, and when the gate voltage is at a high level, the current by a heater voltage flows to a ground via a main heater 240 and the main heater driving FET 230.

An on-resistance of each of the first pass, second pass, and enable FETs 200, 210, and 220 is 200 ohms, which is higher than a resistance of the heater driving FET 230. When the first pass, second pass, and enable FETs 200, 210, and 220 operate in response to control signals Q1 through Q5, and CE, respectively, applied to gates of the first pass, second pass, and enable FETs 200, 210, and 220, the first pass, second pass, and enable FETs 200, 210, and 220 are heated due to the on-resistance, and increase the temperature of a printhead substrate.

However, even in a substrate heating mode or a heater heating mode, the first pass FET 200 always remains "on" and increases the temperature of the printhead substrate, thereby making it difficult to control the temperature of the printhead substrate. In addition, the heater driving FET 230, which is composed of a plurality of transistors (not shown), takes up most of the area of the printhead substrate, and the heatable first and second pass FETs 200 and 210 are uniformly disposed, thereby making it difficult to control the temperature of the printhead substrate.

SUMMARY OF THE INVENTION

The present invention is therefore directed to an apparatus for controlling a temperature of an ink-jet printhead, which substantially overcomes one or more of the problems due to the limitations and disadvantages of the related art.

It is a feature of an embodiment of the present invention to provide an apparatus for controlling a temperature of an ink-jet printhead that has a fast temperature control response.

It is another feature of an embodiment of the present invention to provide an apparatus for controlling a temperature of an ink-jet printhead that warms a heater to a predetermined appropriate temperature and simultaneously heats a printhead substrate.

It is still another feature of an embodiment of the present invention to provide an apparatus for controlling a temperature of an ink-jet printhead that changes operation conditions of a field effect transistor (FET) for driving a heater inside a printhead substrate, thereby heating the printhead substrate using a switching loss of the FET for driving the heater and heat generated by a main heater.

According to an aspect of the present invention, there is provided an apparatus for controlling a temperature of an ink-jet printhead including a heater driving field effect transistor (FET) connected to a heater, the heater driving FET for applying a heater voltage to the heater according to a waveform input to a gate of the heater driving FET, a current sensor for converting current flowing between a drain and a source of the heater driving FET into a voltage and for outputting the voltage, a comparator for comparing the voltage output from the current sensor with a predetermined reference voltage, a warming control signal generator for generating a warming control signal in a form of a pulse string, and a switching unit for receiving an output signal from the comparator and the warming control signal, and for outputting the warming control signal according to a level of the output signal from the comparator to the gate of the heater driving FET.

The warming control signal in the form of a pulse string may have a high duty cycle, whereby the heater driving FET is operable to generate heat by causing a switching loss. The warming control signal generator may be a micro controller.

The current sensor may be a shunt resistor connected between the source of the heater driving FET and a ground.

The switching unit may include a first switching FET including a drain, to which the warming control signal is input, a gate, to which the output signal from the comparator is input, and a source connected to the gate of the heater driving FET.

The comparator may be operable to activate the first switching FET when the voltage output by the current sensor is lower than the predetermined reference voltage.

The switching unit may further include a second switching FET including a gate, to which a discharge enable signal is input, a drain, to which an ink discharge control signal of a printer is input, and a source for outputting the ink discharge control signal according to a level of the discharge enable signal to the gate of the heater driving FET.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
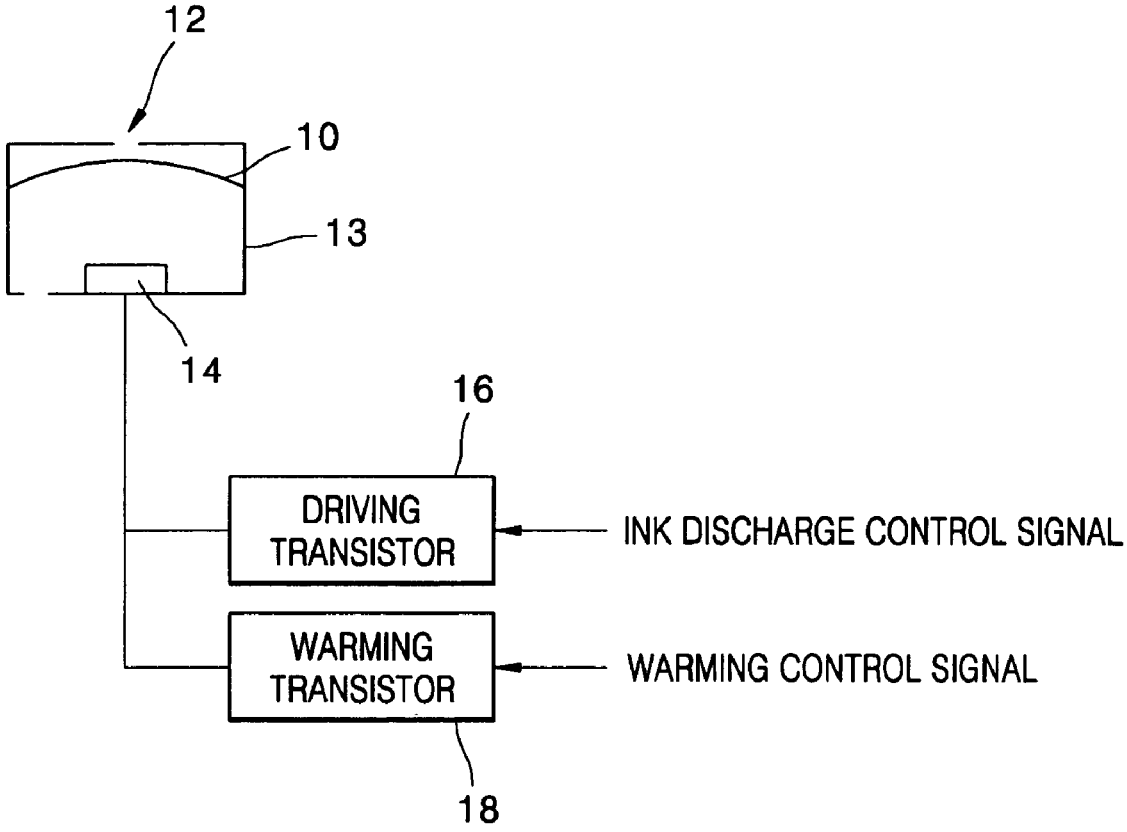
FIG. 1 (PRIOR ART)
FIG. 1 is a block diagram of a conventional apparatus for controlling a temperature of a printhead including only a conventional main heater.
Figure 2:
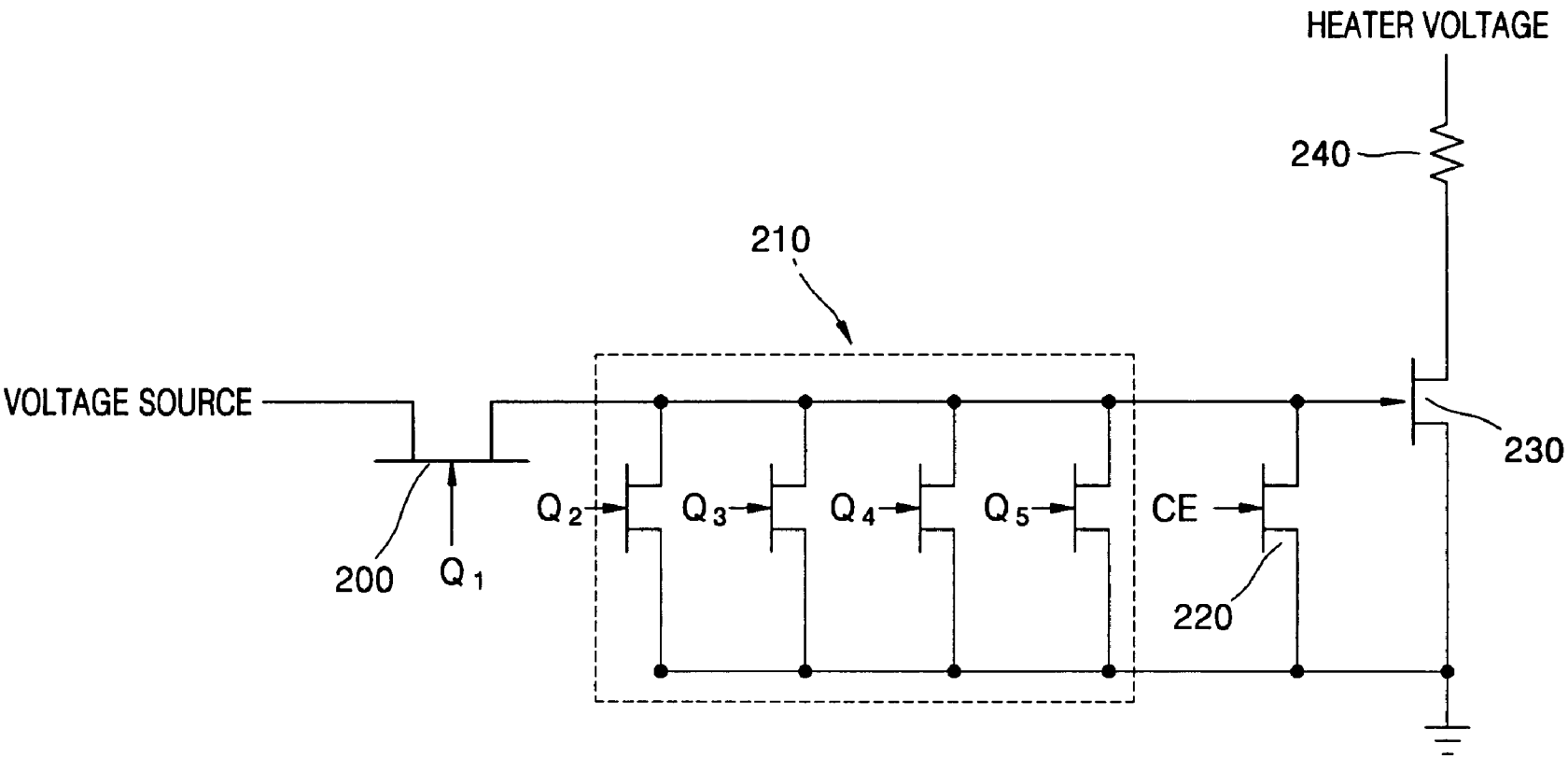
FIG. 2 (PRIOR ART)
FIG. 2 is a circuit diagram of a conventional apparatus for controlling a temperature of a printhead that heats a printhead substrate using an on-resistance of a transistor.

Korean Patent Application No. 2003-83040, filed on Nov. 21, 2003, in the Korean Intellectual Property Office, and entitled: "Apparatus for Controlling Temperature of Ink Jet Head," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Figure 3:
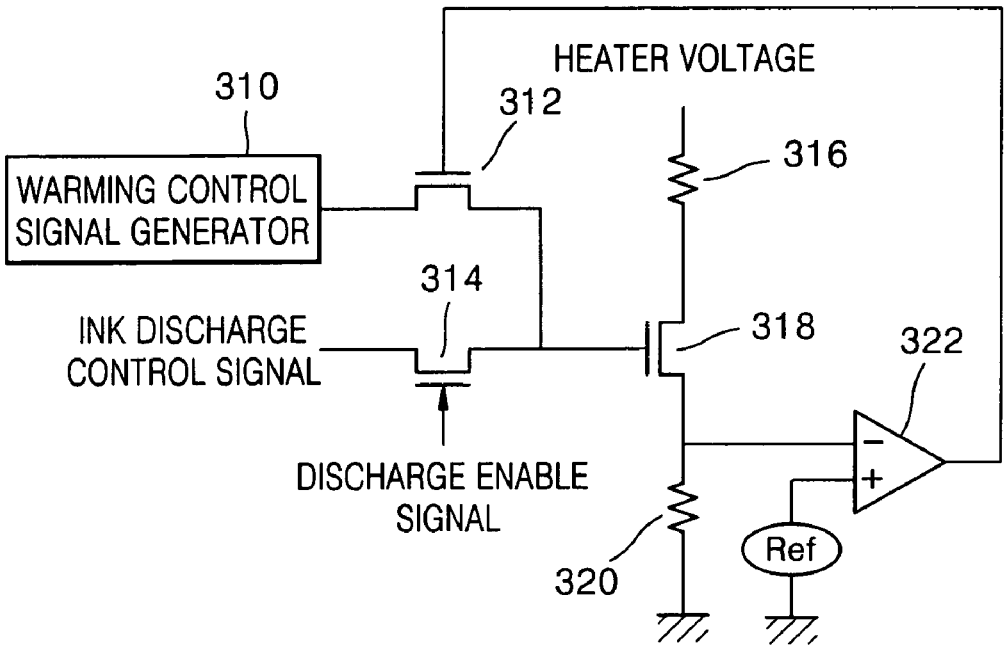
FIG. 3 is a circuit diagram of an apparatus for controlling a temperature of an ink-jet printhead according to an embodiment of the present invention.

FIG. 3 is a circuit diagram of an apparatus for controlling a temperature of an ink-jet printhead according to an embodiment of the present invention.

Referring to FIG. 3, the apparatus includes a heater 316, which is a resistance heater, to heat ink. In operation, a first switching field effect transistor (FET) 312 outputs an input warming control signal in response to a signal input to a gate thereof. A second switching FET 314 outputs a common ink discharge control signal for heating the heater 316 when in an ink discharging mode. A heater driving FET 318 heats the heater 316 by supplying a current to the heater 316 in response to an output signal of the first or second switching FET 312 or 314 applied to a gate of the heater driving FET 318. The heater driving FET 318 is heated due to a switching loss in response to a pulse string of the warming control signal supplied to the gate of the heater driving FET 318. A current sensor 320 converts the current flowing through a drain and a source of the heater driving FET 318 into a voltage range, and outputs the voltage. A comparator 322 compares the voltage output from the current sensor 320 and a reference voltage Ref, and outputs a signal to the gate of the first switching FET 312 depending on the result of the comparison. A warming control signal generator 310 generates and outputs the warming control signal to a drain of the first switching FET 312. The warming control signal generator 310 may be a micro controller.

When a printer prints text, the printer outputs an ink discharge control signal and a discharge enable signal to a drain and a gate of the second switching FET 314, respectively, according to font data that correspond to text stored in a common font memory (not shown).

Figure 4A:
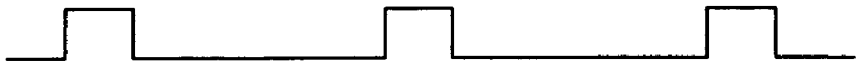
FIG. 4A is a waveform diagram of an ink discharge control signal for heating the heater illustrated in FIG. 3.

A source terminal of the second switching FET 314 connected to a gate of the heater driving FET 318 passes the ink discharge control signal to the heater driving FET 318 according to the discharge enable signal. The heater 316 is connected between the drain of the heater driving FET 318 and the heater voltage, and a current sensor 320, which may be a shunt resistor, having low resistance, is connected between the source of the heater driving FET 318 and a ground to check the current flowing through the heater driving FET 318. Therefore, when the applied ink discharge control signal, as illustrated in FIG. 4A, is at a high level, the heater driving FET 318 is activated, and the heater 316 is heated due to the current flowing through the heater 316, and thus droplets of ink are discharged.

In a printhead substrate heating mode, the voltage across the current sensor 320 is input to a negative input end of the comparator 322, and is compared to a reference voltage Ref, which is input to a positive input end of the comparator 322. Since the inner resistance of the heater driving FET 318 increases as the temperature of the heater driving FET 318 decreases, and the heater power is divided among the heater 316, the heater driving FET 318, and the current sensor 320, the voltage across the current sensor 320 decreases when the temperature of the heater driving FET 318 decreases. Therefore, when the voltage across the current sensor 320 is lower than the reference voltage Ref, an output of the comparator 322 is at a high level and is output to the gate of the first switching FET 312.

Because the warming control signal is input to the drain of the first switching FET 312, the activated first switching FET 312 transmits the warming control signal to the gate of the heater driving FET 318, and thus raises the temperature of the heater 316 and the heater driving FET 318 to a predetermined appropriate temperature.

Figure 4B:
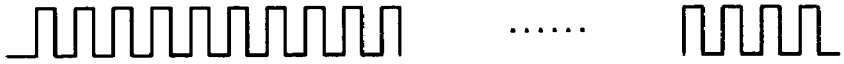
FIG. 4B is a waveform diagram of a warming control signal for heating the heater driving field effect transistor (FET) illustrated in FIG. 3.

As described above, FIG. 4A is a waveform diagram of the ink discharge control signal. FIG. 4B is a waveform diagram of the warming control signal. The warming control signal is composed of pulses having a shorter pulse width than a pulse width of the ink discharge control signal and a pulse string having a high duty cycle.

Figure 5:
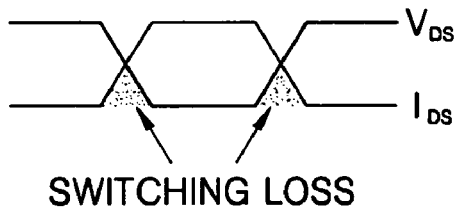
FIG. 5 is a waveform diagram of voltage and current between a drain and a source of the heater driving FET illustrated in FIG. 3 during switching loss.

FIG. 5 is a waveform diagram of voltage and current between a drain and a source of the heater driving FET illustrated in FIG. 3 during switching loss.

The pulse of the warming control signal with the high duty cycle, as illustrated in FIG. 4B, warms the heater 316 to the predetermined temperature. Whenever high and low level voltages are alternately applied to the gate of the heater driving FET 318, the heater driving FET 318 is heated, thereby increasing the temperature of the printhead substrate due to a switching loss generated by inversion of the voltage $V_{DS}$ and current $I_{DS}$ between the drain and the source of the heater driving FET 318, as illustrated in FIG. 5.

When the temperature of the heater driving FET 318 surpasses a reference temperature, the resistance of the heater driving FET 318 is lowered and the voltage across the current sensor 320 is higher than the reference voltage Ref, an output signal of the comparator 322 is at a low level and blocks the warming control signal at the first switching FET 312. Therefore, the heating caused by the switching loss at the heater driving FET 318 is stopped and the temperature of the printhead is controlled.

Figure 6A:
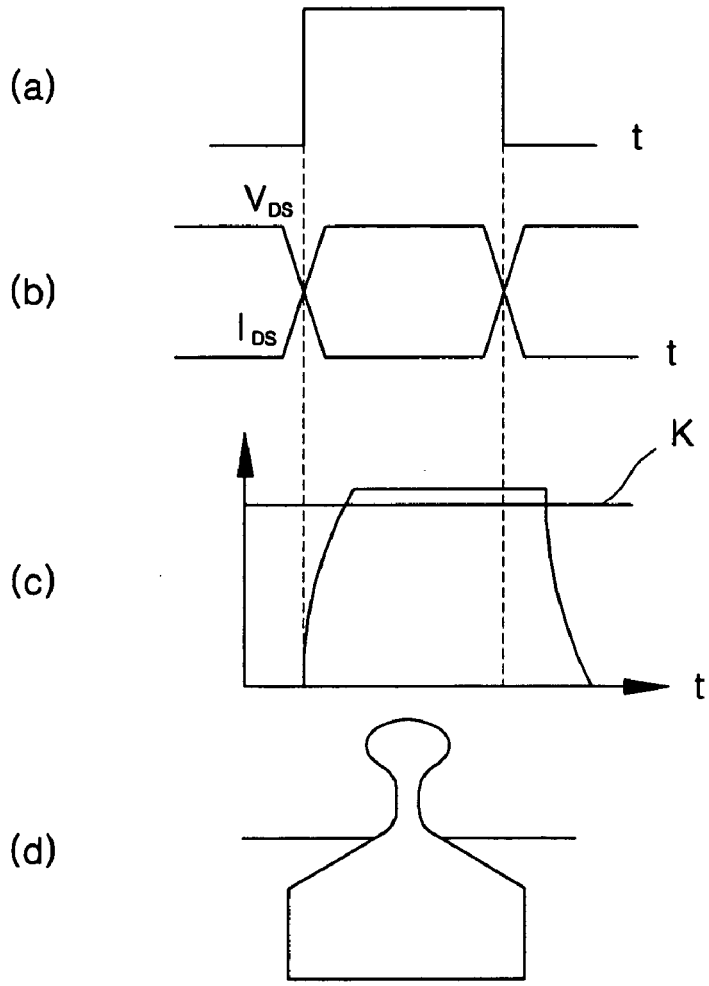
FIGS. 6A(*a*) through (*d*) are a waveform diagram of the ink discharge control signal applied to the heater driving FET illustrated in FIG. 3, a plot of the voltage and the current between the drain and source of the printhead driving FET caused by the ink discharge control signal, a graph of the temperature of the heater versus time, and an illustration of a chamber discharging ink, respectively.

FIG. 6A(*a*) is a waveform diagram of the ink discharge control signal applied to the heater driving FET 318 illustrated in FIG. 3. FIG. 6A(*b*) is a plot of the voltage $V_{DS}$ and the current $I_{DS}$ between the drain and source of the printhead driving FET 318 caused by the ink discharge control signal. FIG. 6A(*c*) is a graph of the temperature of the heater 316 versus time. FIG. 6A(*d*) illustrates a chamber discharging ink.

As shown in FIG. 6A, in the ink discharging mode, when a common heating control signal having a pulse width that can heat the heater 316 to a temperature that can generate an ink bubble is applied to the gate of the heater driving FET 318, the temperature of the heater 316 is increased above a temperature K required to generate ink bubbles and the ink is discharged from the chamber.

Figure 6B:
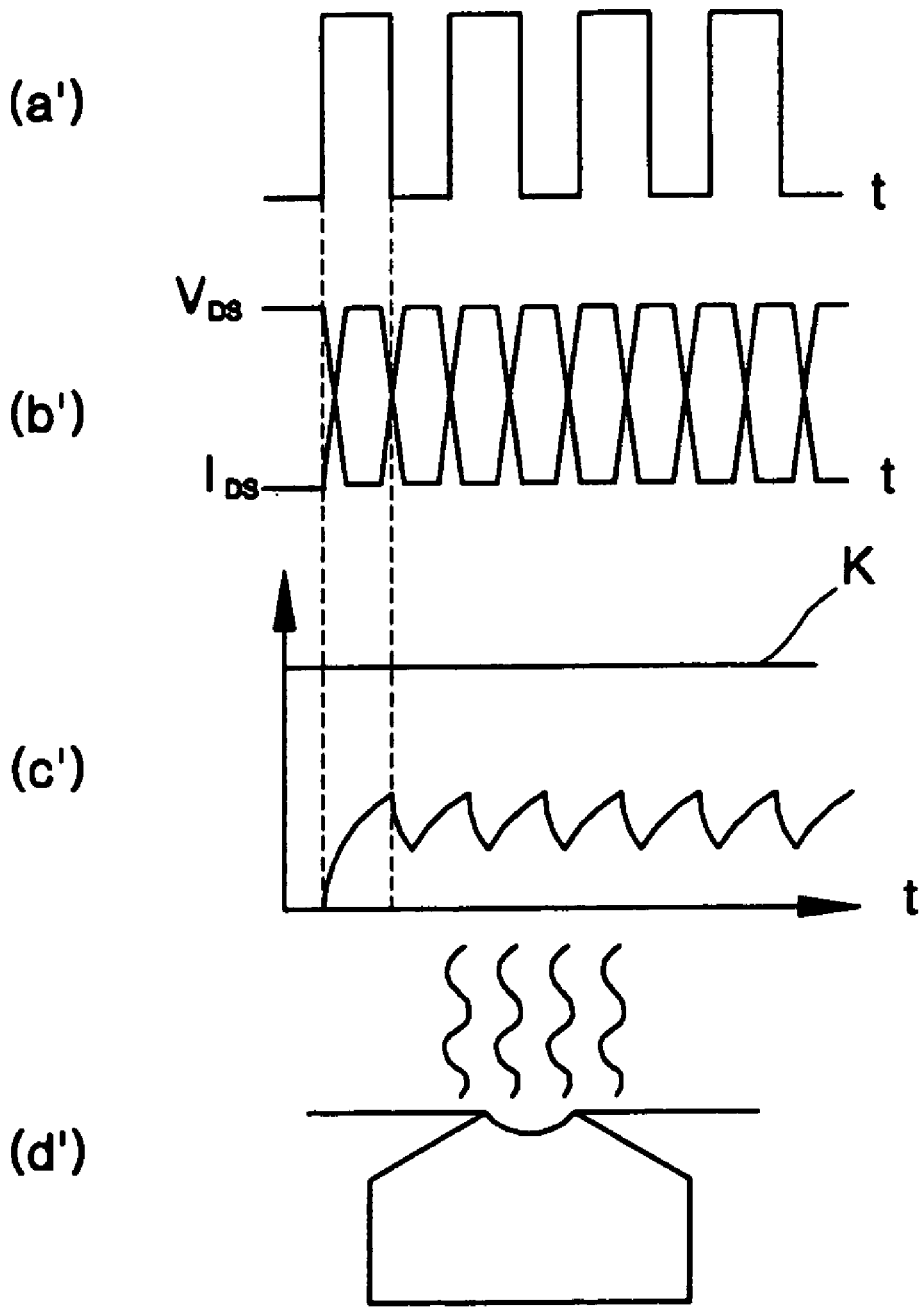
FIGS. 6B(*a*)' through (*d*)' are a waveform diagram of the warming control signal applied to the heater driving FET illustrated in FIG. 3, a plot of the voltage and the current between the drain and source of the printhead driving FET caused by the ink discharge control signal, a graph of the temperature of the heater versus time, and an illustration of a chamber in the printhead substrate heating mode, respectively.

FIG. 6B(*a'*) is a waveform diagram of the warming control signal applied to the heater driving FET 318 illustrated in FIG. 3. FIG. 6B(*b'*) is a plot of the voltage $V_{DS}$ and the current $I_{DS}$ between the drain and source of the printhead driving FET 318 caused by the ink discharge control signal. FIG. 6B(*c'*) is a graph of the temperature of the heater 316 versus time. FIG. 6B(*d'*) illustrates a chamber in the printhead substrate heating mode.

In the substrate heating mode, the pulse string of the warming control signal is applied to the gate of the heater driving FET 318 and has a higher duty cycle than in the ink discharging mode. However, due to the short pulse width of the pulse string, insufficient power is supplied to cause the ink to discharge. In particular, the temperature of the heater 316 does not increase to the temperature K required to generate an ink bubble, and the ink is maintained at the predetermined temperature. In addition, the heater driving FET 318 heats the printhead substrate using heat generated due to the switching loss, without requiring a transistor using a separate on-resistance or a supplementary heater, such as a resistance heater.

As described above, according to the present invention, an apparatus for controlling the temperature of an ink-jet printhead with improved temperature control response is provided. The apparatus maintains a printhead substrate at a predetermined temperature by heating a heater to a temperature lower than a temperature at which ink bubbles are generated using a warming control signal composed of a pulse string with a high duty cycle and by simultaneously heating a heater driving FET using a switching loss when a temperature of the heater driving FET is lower than a reference temperature.

Exemplary embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An apparatus for controlling a temperature of an ink-jet printhead, comprising:

a heater driving field effect transistor (FET) connected to a heater, the heater driving FET for applying a heater voltage to the heater according to a waveform input to a gate of the heater driving FET;

a current sensor for converting current flowing between a drain and a source of the heater driving FET into a voltage and for outputting the voltage;

a comparator for comparing the voltage output from the current sensor with a predetermined reference voltage;

a warming control signal generator for generating a warming control signal in a form of a pulse string; and a switching unit for receiving an output signal from the comparator and the warming control signal, and for outputting the warming control signal according to a level of the output signal from the comparator to the gate of the heater driving FET.

2. The apparatus as claimed in claim 1, wherein the warming control signal in the form of a pulse string has a high duty cycle, whereby the heater driving FET is operable to generate heat by causing a switching loss.

3. The apparatus as claimed in claim 1, wherein the warming control signal generator is a micro controller.

4. The apparatus as claimed in claim 1, wherein the current sensor is a shunt resistor connected between the source of the heater driving FET and a ground.

5. The apparatus as claimed in claim 1, wherein the switching unit comprises a first switching FET including:

a drain, to which the warming control signal is input;

a gate, to which the output signal from the comparator is input; and a source connected to the gate of the heater driving FET.

6. The apparatus as claimed in claim 5, wherein the comparator is operable to activate the first switching FET when the voltage output by the current sensor is lower than the predetermined reference voltage.

7. The apparatus as claimed in claim 6, wherein the switching unit further comprises a second switching FET including:

a gate, to which a discharge enable signal is input;

a drain, to which an ink discharge control signal of a printer is input; and a source for outputting the ink discharge control signal according to a level of the discharge enable signal to the gate of the heater driving FET.

* * * * *